US010464123B2

(12) United States Patent
Stratmann et al.

(10) Patent No.: US 10,464,123 B2
(45) Date of Patent: Nov. 5, 2019

(54) PRODUCTION METHOD USING A VACUUM SAND CASTING MOULD

(71) Applicant: GF Casting Solutions Mettmann GmbH, Mettmann (DE)

(72) Inventors: Christoph Stratmann, Mettmann (DE); Andreas Güll, Duisburg (DE)

(73) Assignee: GF Casting Solutions AG (CH)

( * ) Notice: Subject to any disclaimer, the term of this patent is extended or adjusted under 35 U.S.C. 154(b) by 0 days.

(21) Appl. No.: 15/812,495

(22) Filed: Nov. 14, 2017

(65) Prior Publication Data

US 2018/0133783 A1 May 17, 2018

(30) Foreign Application Priority Data

Nov. 15, 2016 (EP) ..... 16198875

(51) Int. Cl.

| | |
|---|---|
| ***B22C 9/03*** | (2006.01) |
| ***B22C 9/06*** | (2006.01) |
| ***B22D 30/00*** | (2006.01) |
| ***B22C 9/04*** | (2006.01) |
| ***B22D 27/15*** | (2006.01) |

(Continued)

(52) U.S. Cl.

CPC ..... *B22C 9/046* (2013.01); *B22C 7/023* (2013.01); *B22C 9/03* (2013.01); *B22C 9/065* (2013.01); *B22D 18/04* (2013.01); *B22D 27/15* (2013.01); *B22D 30/00* (2013.01)

(58) Field of Classification Search

CPC ..... B22C 9/03; B22C 9/065; B22D 30/00

See application file for complete search history.

(56) References Cited

U.S. PATENT DOCUMENTS

| | | | |
|---|---|---|---|
| 4,222,429 A | 9/1980 | Kemp | |
| 7,121,318 B2 | 10/2006 | Grassi et al. | |
| 7,216,691 B2 | 5/2007 | Grassi et al. | |

FOREIGN PATENT DOCUMENTS

| | | | |
|---|---|---|---|
| DE | 3240808 A1 * | 5/1984 | ..... B22D 30/00 |
| DE | 11-2006-000627 T5 | 4/2008 | |
| EP | 1731242 A1 | 12/2006 | |

(Continued)

OTHER PUBLICATIONS

EPO machine translation of JP-2008264819-A (Year: 2008).*

(Continued)

*Primary Examiner* — Kevin E Yoon

(74) *Attorney, Agent, or Firm* — Harness, Dickey & Pierce, P.L.C.

(57) ABSTRACT

A production method for producing cast parts from metal using a sand casting mold (1). The sand casting mold (1) is produced in this case in a molding box (2) by means of a negative-pressure molding method. According to the invention, the sand casting mold (1), which is under negative pressure, in the molding box (2) is first of all filled with molten metal (5). The molding box (2) with the sand casting mold (1), which is under negative pressure therein, is then completely or partially impinged upon by a cooling fluid (4) and after, at the same time as, or before the cooling fluid impingement is opened at places with cooling fluid impingement. As a result of this, cooling fluid (4) is sucked into the sand casting mold (1) which is under negative pressure, as a result of which the solidifying cast part (3) is quenched more quickly.

2 Claims, 4 Drawing Sheets

(51) Int. Cl.
*B22C 7/02* (2006.01)
*B22D 18/04* (2006.01)

(56) References Cited

FOREIGN PATENT DOCUMENTS

| | | | | |
|---|---|---|---|---|
| JP | S57-85636 | A | | 5/1982 |
| JP | S62-77148 | A | | 4/1987 |
| JP | H04-84662 | A | | 3/1992 |
| JP | 2008264819 | A | * | 11/2008 |

OTHER PUBLICATIONS

EPO machine translation of DE 3240808 A1 (Year: 1984).*
Extended European Search Report (in German) regarding Application No. EP 16198875 dated Jun. 12, 2007 (6 pages).

* cited by examiner

PRIOR ART
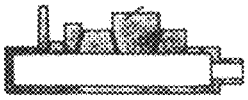
Figure 1.1
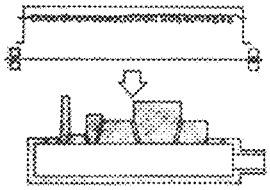
Figure 1.2
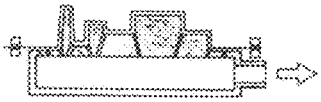
Figure 1.3
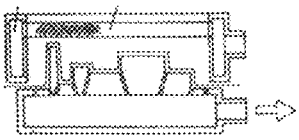
Figure 1.4
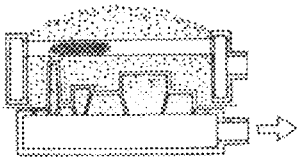
Figure 1.5
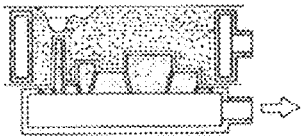
Figure 1.6
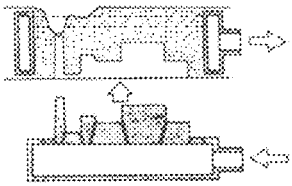
Figure 1.7
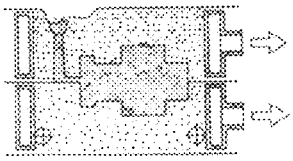
Figure 1.8
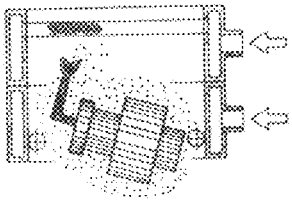
Figure 1.9

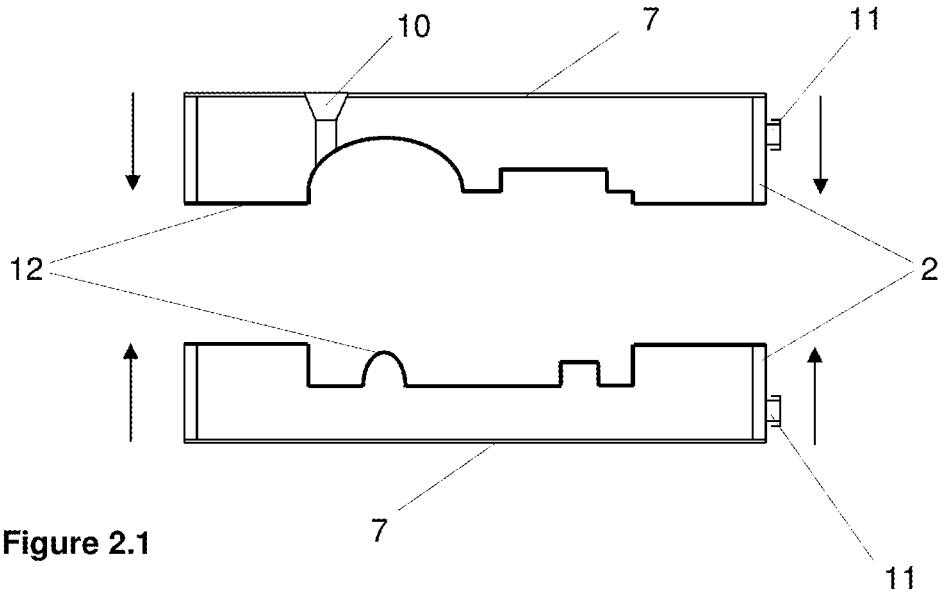
Figure 2.1
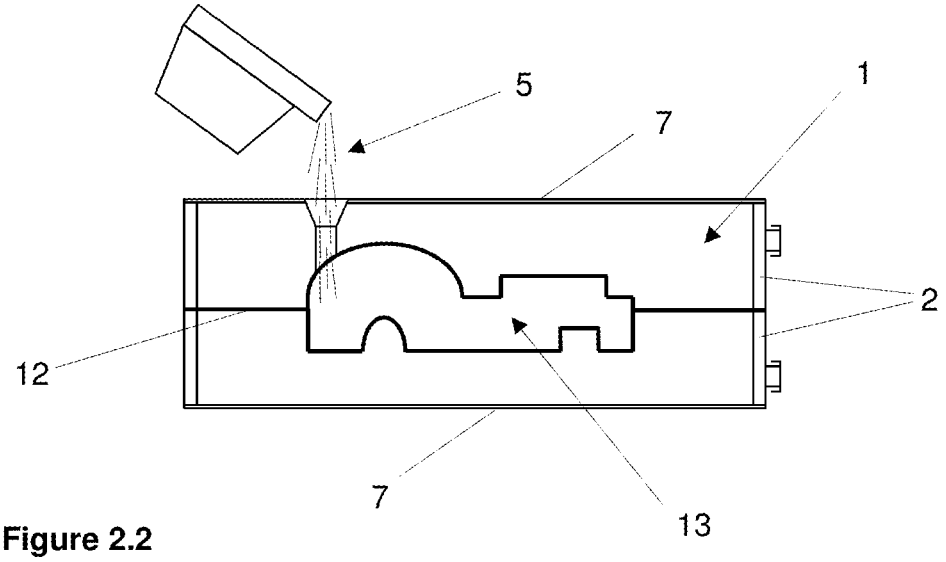
Figure 2.2

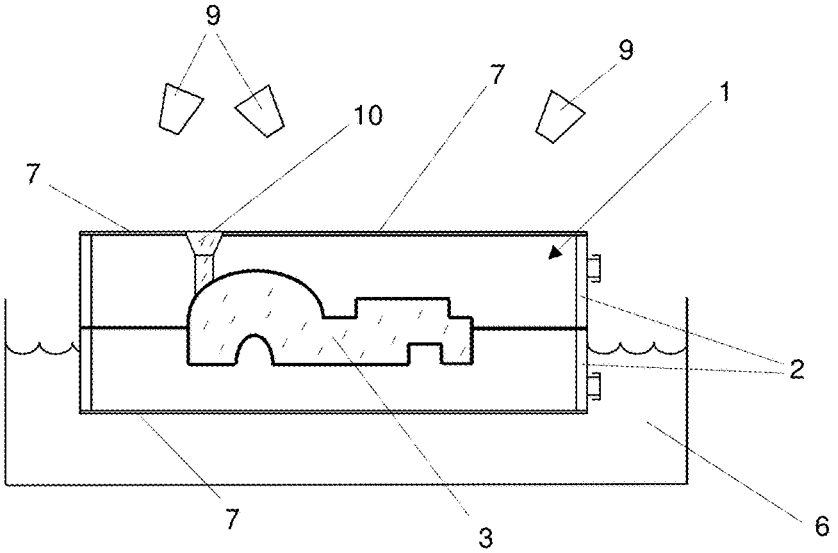
Figure 3.1
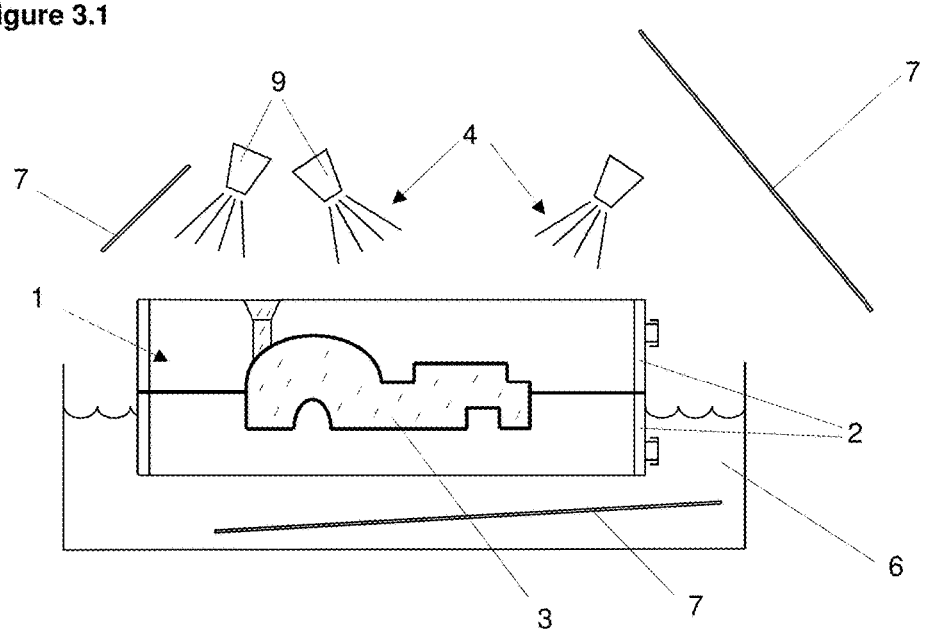
Figure 3.2

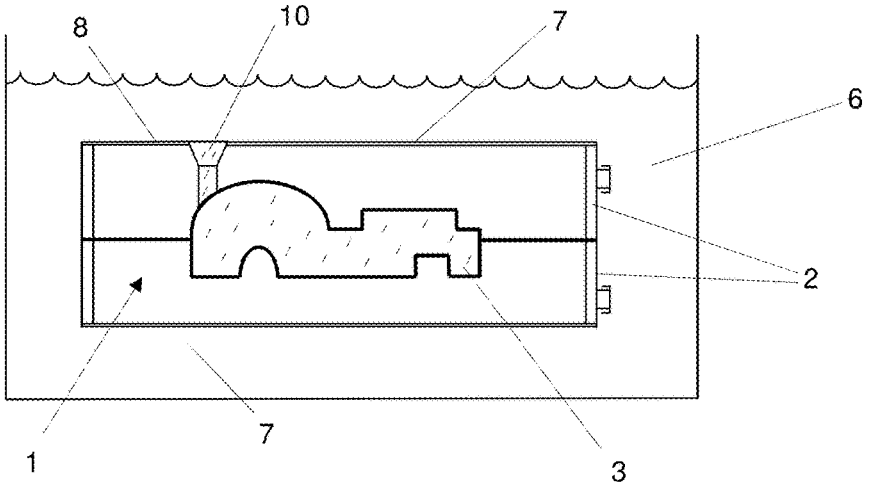
Figure 4.1
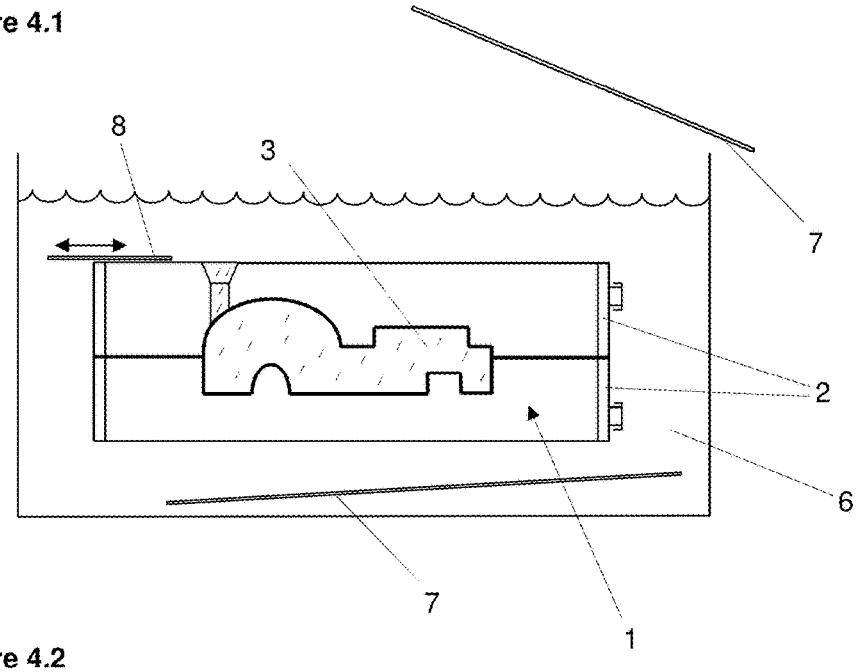
Figure 4.2

PRODUCTION METHOD USING A VACUUM SAND CASTING MOULD

CROSS-REFERENCE TO RELATED APPLICATIONS

This application claims the benefit and priority of EP 16 198 875.3, filed Nov. 15, 2016. The entire disclosure of the above application is incorporated herein by reference.

FIELD

The present invention relates to a method for producing cast parts from metal using a sand casting mould.

BACKGROUND

The present invention especially relates to cast part production using sand casting moulds which are produced by means of a negative-pressure moulding method. Casting methods for producing cast parts from metal, e.g., from alloys of iron, aluminium or magnesium are generally known. Typical casting methods which require sand casting moulds are gravity casting or low-pressure casting.

In the case of low-pressure casting, a moulding box with a sand casting mould which is under a vacuum or negative pressure is positioned over a pressurised casting device. The moulding box with the sand casting mould which is under a vacuum/negative pressure is then docked via the sprue opening of the moulding box on the furnace outlet of the pressurised casting device and connected to this in a non-positive locking manner. As a result of a controlled pressure build-up in the furnace interior, molten metal rises via a furnace riser pipe into the furnace outlet of the pressurised casting device and flows via the sprue opening of the moulding box into the sprue of the sand casting mould. The sprue of the sand casting mould leads into a gate region which distributes the flow of molten metal via a runner system and optimally fills the mould cavities of the sand casting mould. So that while the molten metal is flowing no turbulences develop or material-specific critical velocities are exceeded, which mechanically or chemically (oxidation processes) negatively influence the eventual component, the flow velocity of the molten metal is controlled via the pressure in the pressurised casting device. After casting has been carried out, the sand casting mould is allowed to cool until the cast part which is produced thereby has sufficiently solidified to the extent that this can be shaken out of the moulding box. The sand casting mould is for example guided over a vibrating table so that the sand separates from the cast part.

In the case of gravity casting, a sand casting mould is filled from the top with molten metal. The metal flows owing to gravity—mostly turbulently—into the sprue of the sand casting mould and is also distributed there in the gate region via distribution runners into the cavities of the casting mould. By inserting corresponding filters in the sprue of the sand casting mould a laminar flow can also be created during the gravity casting. The filters have the additional advantage that impurities or oxidation products can be filtered out of the molten metal as well.

The described low-pressure casting method or the gravity casting is used especially for the casting of light metals, e.g., aluminium alloys.

For casting on an industrial scale, it is important to operate the casting plant as efficiently as possible. Therefore, it is important to achieve short cycle times for producing the individual cast parts. An important factor for the cycle time is the cooling rate of the produced component. The quicker the cast part solidifies, or is sufficiently hard, in order to shake it out of the sand casting mould or the moulding box, the more efficiently can the casting plant be operated.

A faster quenching or solidifying of the molten metal, however, also brings with it improved mechanical properties for the produced cast part. In other words, as a result of a fast and targeted cooling of the melt metal structures with better mechanical properties are created (e.g., solidification of the cast part).

In order to accelerate the cooling of the sand casting mould, solutions from the prior art are already known.

Document U.S. Pat. No. 7,121,318 proposes that after the filling of a sand mould (a sandstone conglomerate with a binding agent) with molten metal, the sand mould comes into contact with a solvent, e.g., water. As a result, the molten metal is cooled more quickly in the boundary regions and begins to solidify there. The boundary region of the cast part with solidified surface also comes directly into contact with solvent in the process and is consequently further quenched. Due to the solvent, the sand casting mould is also dissolved in the cooled region. Document U.S. Pat. No. 7,121,318 proposes that the sand casting mould is immersed into a bath which is filled with the solvent.

In a further document, U.S. Pat. No. 7,216,691, it is proposed to spray a sand casting mould, filled with molten metal, with water or to immerse it into a water bath for the purpose of faster cooling of the casting mould or faster solidifying of the cast part which is contained therein. The aim in this case is also the dissolution of the sand casting mould. As a result of the targeted impingement of individual regions of the sand casting mould with the cooling agent, a zonally directed quenching is also achieved and therefore also zonally better mechanical properties in the produced cast part.

Document DE-11-2006-000627-T5 describes a further method and a sand casting mould with improved heat dissipation, preferably for producing cast parts from aluminium alloys. The sand mould and the cores consist of silica sand which are mixed with a water-soluble binding agent so that the silica sand remains in the desired form. For the purpose of targeted solidification of specific places on the cast part which is to be produced, water-soluble cores are inserted at corresponding places of the sand casting mould. If after the casting process has been carried out the sand casting mould is sprayed with a water jet at the places with inserted, water-soluble cores, then the water-soluble binding agent dissolves and the cores are washed away. As a result, not only a solidified boundary region forms on the cast part in a relatively short space of time at this place but the cast part is also quenched even faster as soon as the core is washed away and the water jet comes directly into contact with the solidified cast part surface. Consequently, a local solidification of the cast part can also take place.

Document U.S. Pat. No. 4,222,429 describes a cooling method for a vacuum sand casting mould. In this case, the sand casting mould, which is under negative pressure, is filled with molten metal. By means of the negative pressure in the sand casting mould which continues to exist as a result of the suction, gases which are possibly additionally created (evaporating styrene resin) during the casting process are discharged from the sand casting mould. For cooling the sand casting mould, a gas is then purged through the (porous) casting mould following the solidification of the cast part and then sucked out of it again, as a result of which an additional cooling or quenching of the casting mould and of the cast part is effected. Used as the cooling gas is for example air which is pumped by means of a compressor into the sand casting mould. Steam can also be used for purging instead of air. This purging of the sand casting mould creates a heat dissipation. In addition to the purging of the sand casting mould with a cooling gas or air, the sand casting mould can still be sprayed with water from the outside.

SUMMARY

The present invention is based on the object of providing a method for producing cast parts, which greatly improves the cooling of sand casting moulds, which are produced by means of negative-pressure moulding methods, and of the cast parts which solidify therein.

Known casting methods for producing cast parts using a sand casting mould include the following steps:

- Producing the sand casting mould in a moulding box by means of a negative-pressure moulding method
- Filling the produced sand casting mould in the moulding box with molten metal
- Cooling the sand casting mould and the cast part solidifying therein with a cooling liquid (e.g., water).

The method according to the preferred embodiment of the invention, however, additionally includes the following specific steps:

- The sand casting mould, which is under negative pressure, in the moulding box is first of all filled with molten metal
- The moulding box with the sand casting mould, which is under negative pressure therein, is completely or partially impinged upon by a cooling liquid
- The moulding box—after or immediately before the cooling liquid impingement—is opened at places with cooling liquid impingement so that the cooling liquid is sucked into the sand casting mould which is under negative pressure and as a result the solidifying cast part is quenched.

The method according to the invention has many advantages compared with known casting methods. Owing to the use of sand casting moulds which are produced in the negative-pressure method, a binding agent is not required (cost saving). The sand preparation is very simple. There is no requirement for expensive and bulky sand preparation units. Sand consumption using the production method according to the invention is low and correspondingly environmentally friendly because no additives are required. Sand casting moulds which are produced by means of negative-pressure moulding methods require smaller mould tapers and can even have reverse tapers in contrast to other sand casting moulds. Since the sand casting moulds which are produced in the negative-pressure method contain no water, no water vapour is created during the casting process. With this, smaller wall thicknesses on the cast part can also be cast. Cast parts which are produced with this have, moreover, a higher dimensional accuracy and can have a very fine surface since sand with smaller grain size can be used. Even a flash-free production is possible. The cast parts do not necessarily then have to be sand-blasted.

The production method according to the invention can, moreover, be used in all known and current casting methods.

In the production method according to the invention, the quenching of the cast part with water or another cooling liquid is maximised as a result of the suction effect which is created. The cooling liquid penetrates into the porous sand casting mould far more quickly and deeply so that considerably higher cooling rates of the cast parts are achieved than with conventional cooling methods. As a result of the contact of the edge-solidified cast part in the sand casting mould with the cooling liquid, the heat is dissipated with sudden effect. Owing to the extreme cooling rate, both the primary dendrite formation as well as the eutectic solidification result in being fine grained. The suction action is improved, moreover, by the cavities between the sand grains not being blocked by binding agent. The sand casting mould is therefore much more porous and the cooling liquid is sucked into the sand casting mould with sudden effect as a result of the negative pressure without being impeded during the through-flow.

DRAWINGS

In the following text, the production method according to the invention and its principle of operation are explained based on exemplary embodiments. Reference is expressly to be made, however, to the fact that the method according to the invention and the inventive idea are not limited to the embodiments which are featured in the examples. In the drawing:

FIG. 1 shows production of a sand casting mould using known negative-pressure or vacuum moulding methods FIG. 2.1 shows preparation of the moulding box with the sand casting mould which is under negative pressure FIG. 2.2 shows filling of the sand casting mould with molten metal FIGS. 3.1 and 3.2 show cooling and shaking out according to the invention of the sand casting mould which is under negative pressure FIGS. 4.1 and 4.2 show further variants for the cooling and shaking out according to the invention of the sand casting mould which is under negative pressure

DETAILED DESCRIPTION

FIGS. 1.1-1.9 show the production of a sand casting mould according to the negative-pressure moulding method. The depicted method is prior art and can also be used in the inventive production method. The first figure (FIG. 1.1) shows the preparation of a negative-pressure box with a pattern half of the cast part mould which is to be produced. Attached to the pattern half is a sprue gate mould through which the molten metal is to later flow into the sand casting mould. Shown in the second figure (FIG. 1.2) is a first process step for producing the sand casting mould. In this case, a foil or pattern foil is heated until it becomes plastically deformable. Next, the pattern foil is lowered from the top over the sprue gate mould and the pattern half (FIG. 1.3). By means of suction on the lower-box pattern plate, a negative pressure is created (see arrow), sucking the pattern foil onto the pattern half and onto the sprue gate. The pattern half and the sprue gate mould can be dispersed with small holes for the purpose of better suction of the pattern foil. The pattern foil cools down and remains in the patterned form. Optionally, facing material can then additionally be applied to the pattern foil. In illustrations of FIGS. 1.4-1.9, it is shown how the moulding box upper part is positioned above the pattern half, with the pattern foil drawn over, and filled with sand, e.g., silica sand, and finally closed off with an upper cover foil. In the moulding box upper part a negative pressure is now also created by the air being sucked out of it (see arrows in the figures). The vacuum or negative pressure in the moulding box upper part is kept stable by means of pumps so that the negative pressure in the moulding box stays in effect. The moulding box upper part is now detached from the pattern half and from the sprue gate mould (see FIG. 1.7). The casting mould half which is produced therewith from sand remains in its shape as a result of the exerted negative pressure, similar to a vacuum packing for foodstuff. The advantages which arise from this have already been explained further above. The moulding box lower part together with the lower casting mould half are produced in the same manner. The moulding box upper part and the associated moulding box lower part are then joined together and interconnected in a non-positively locking manner. The moulding box with the sand casting mould, which is under negative pressure therein, is now ready for filling with molten metal (see FIG. 1.8). After the molten metal has solidified, forming the cast part, the negative pressure can be released and the produced cast part removed from the moulding box (see FIG. 1.9).

FIGS. 2.1 and 2.2 show in schematic view the two-part moulding box 2, wherein each mould box half 2 contains a sand casting mould half which is kept under negative pressure. FIG. 2.1 also shows how both sand casting mould halves are kept in their shape formed by the pattern foils 12 on account of the negative pressure. The negative pressure in the two cast part mould halves is maintained in each case by the moulding box 2, and also by a moulding-box cover foil 7 and a pattern foil 12. The schematic figures show a suction point 11 on both moulding box halves, by means of which air is sucked out of the mould halves and the negative pressure therefore created. The moulding box upper part additionally has a sprue gate 10 through which the melt is poured into the closed casting mould in a later step. According to FIG. 2.1, the two moulding box halves with negative pressure applied are laid one on top of the other and interconnected in a non-positively locking manner. In FIG. 2.2, both moulding box halves are joined together. These are interconnected in a non-positively locking manner so that the sand casting mould does not open during the casting process. The two moulding box halves form the actual moulding box 2 with the sand casting mould 1, assembled from the two sand casting-mould halves, therein. The assembled sand casting mould 1 forms a cavity 13 which has the shape of the cast part which is to be produced. The closed moulding box 2 can now be filled with the melt, i.e., molten metal 5. The present invention can be used in any casting method, e.g., in gravity or pressure casting methods described further above. Further current and applicable casting methods would be, for example, tilt pouring, top pouring or side pouring. The sand casting mould 1 according to FIG. 2.2 is now filled with molten metal, wherein the molten metal cools and—initially in the boundary regions toward the sand mould—slowly begin to solidify.

The FIGS. 3.1 and 3.2 now show the inventive method step: The moulding box 2 with the sand casting mould 1, which continues to be under negative pressure therein and is filled with molten, partially solidified metal, is moved away from the casting device (not shown). The casting device is therefore freed for the next casting process, i.e., filling of a further moulding box. For this, the filled moulding box 2 is moved away from the casting device, for example by a robot, not shown, and swung over a cooling device. The cooling device, as shown in FIGS. 3.1 and 3.1, can consist of a large cooling basin or bath 6 (e.g., a water bath). In addition to the actual cooling basin 6, the cooling device can also have nozzles 9 for cooling liquid impingement, which nozzles spray the moulding box 2, filled with molten metal, with a cooling liquid from different directions, e.g., from the top. Water is typically used as cooling liquid or coolant.

The moulding box 2 is now for example partially immersed into the cooling basin 6 and sprayed from the top with the cooling liquid by means of the nozzles 9. The moulding box 2 can even be totally immersed into the cooling basin 6, wherein no additional nozzles are then necessary. The moulding box 2 with the sand casting mould 1 continuing to be under negative pressure is now according to the invention completely opened, or opened only at the places with impingement of cooling liquid. This takes place by the moulding box cover foils 7 being removed. The invention now makes use of the suction effect of the negative pressure (typically −0.6 to −0.8 bar). By removing the cover foils 7, water is momentarily sucked into the sand casting mould 1 which momentarily quenches the cast part 3. Since the sand casting mould 1 consists of sand, i.e., silica sand, and does not contain a blocking binding agent (e.g., bentonite) or other fine proportions, the water, owing to the pre-existing negative pressure/vacuum can penetrate very quickly and deeply into the porous sand casting mould, i.e., between the individual sand grains. Although a sand casting mould acts in a very compact manner, it is in reality porous and has a theoretical mould cavity between the sand grains which can constitute 33% of the entire sand casting mould volume. On account of this, the inventive cooling or quenching effect is very high in comparison to the known cooling methods.

The method according to the invention also being used with negative-pressure sand casting moulds, which are provided with additives, is naturally not excluded. As is to be gathered from the preceding embodiments, attention has to be paid here to the fact that the additives which are used do not negatively impair, or least do not negatively impair to an excessive extent, the porosity of the sand casting mould or its permeability for the cooling liquid. Accordingly, bentonite should by preference not be used as additive/binding agent because on contact with water this closes off the cavities between the sand grains and therefore makes the sand mould impermeable for water (despite the negative pressure little or no water is sucked into the sand mould).

After the cover foils 7 of the moulding box have been removed, it is also conceivable that the moulding box 2 is immersed more deeply into the cooling basin 6. The immersion of the moulding box 2 into the water bath 6 offers the additional advantage that the immersion process can be carried out in a controlled or regulated manner. That is to say, the cooling process can be influenced via the immersion direction and rate. Therefore, the moulding box can be immersed for example horizontally in the casting position, at an angle, or rotated by 180 degrees around a horizontal or a vertical axis. Correspondingly, specific regions of the cast part can be quenched more quickly via the immersion direction and/or rate.

FIGS. 4.1 and 4.2 show a further variant of the method according to the invention. In this case, the moulding box 2, filled with molten metal, is immersed completely into a water bath 6 before the cover foils 7 on the moulding box are removed. The suction effect for quenching the molten or partially already edge-solidified cast part 3 with the cooling liquid is used more efficiently in this case. As is shown in FIGS. 4.1 and 4.2, the moulding box can also have slides 8 instead of the cover foils 7. These slides 8 undertake the function of cover foils here. Depending on application and mould box size, the use of slides—e.g., on the mould-box underside—can be more advantageous than the use of cover foils. The slides can also be used again without any problem.

In the preceding description, it was explained that the moulding box, after the cooling liquid impingement, is opened by removing the cover foils or slides. Naturally, the inventive idea also embraces the possibility that the (partial) opening of the moulding box is carried out before, or immediately before, or at the same time with the cooling liquid impingement. The moulding box can therefore be opened before or even after the cooling liquid impingement (preferably only at the places with cooling liquid impingement). The suction effect, and therefore cooling effect, which is used according to the invention is, of course, used to the most efficient extent if the sand casting mould sucks up only, or for the most part only, cooling liquid and not also ambient air (significantly lower thermal capacity). It is therefore to be preferred that the moulding box is opened by removing the cover foils or slides only after the cooling liquid impingement.

The present invention is not limited to the possibilities and embodiments which are explicitly referred to. These variants are rather thought as being a stimulus for the person skilled in the art in order to implement the inventive idea as favourably as possible.

LIST OF DESIGNATIONS

1 Sand casting mould
2 Moulding box, moulding box half
3 Cast part
4 Cooling liquid, water
5 Molten metal
6 Cooling basin, cooling bath
7 Moulding box cover foil
8 Moulding box slide
9 Nozzles for cooling liquid impingement
10 Sprue gate
11 Suction point of the sand casting mould
12 Pattern foil
13 Cavity of the sand casting mould

What is claimed is:

1. A method for producing cast parts from metal using a sand casting mould, comprising:

producing the sand casting mould in a moulding box by a negative-pressure moulding method filling the produced sand casting mould in the moulding box with molten metal cooling the sand casting mould and the cast part solidifying therein with a cooling liquid, wherein the sand casting mould, which is under negative pressure, in the moulding box is first filled with molten metal, the moulding box with the sand casting mould, which is under negative pressure therein, is then completely or partially impinged upon by a cooling liquid;

the moulding box after, at the same time as, or before the cooling liquid impingement is opened at places with cooling liquid impingement so that the cooling liquid is sucked into the sand casting mould which is under negative pressure and as a result quenches the solidifying cast part; and the impingement of the moulding box with the cooling liquid is carried out in a cooling basin, the moulding box is partially or completely immersed into the cooling basin in this case.

2. A method for producing cast parts from metal using a sand casting mould, comprising:

producing the sand casting mould in a moulding box by a negative-pressure moulding method filling the produced sand casting mould in the moulding box with molten metal cooling the sand casting mould and the cast part solidifying therein with a cooling liquid, wherein the sand casting mould, which is under negative pressure, in the moulding box is first filled with molten metal, the moulding box with the sand casting mould, which is under negative pressure therein, is then completely or partially impinged upon by a cooling liquid;

the moulding box after, at the same time as, or before the cooling liquid impingement is opened at places with cooling liquid impingement so that the cooling liquid is sucked into the sand casting mould which is under negative pressure and as a result quenches the solidifying cast part;

wherein the moulding box is immersed into a cooling basin horizontally in the casting position or in a position rotated by an angle of 0 to 180 degrees around a horizontal or vertical axis, the immersion into a cooling basin taking place in a time-controlled manner.

* * * * *